United States Patent [19]

Greve et al.

[11] 4,320,267

[45] Mar. 16, 1982

[54] MULTIPLE-FUNCTION SWITCH WITH AUTOMATIC RETURN

[75] Inventors: James E. Greve, South Bend, Ind.; John Zdanys, Jr., Edwardsburg, Mich.

[73] Assignee: CTS Corporation, Elkhart, Ind.

[21] Appl. No.: 164,781

[22] Filed: Jun. 30, 1980

[51] Int. Cl.[3] ..... H01H 9/00; H01H 21/76

[52] U.S. Cl. ..... 200/4; 200/11 G; 200/11 K; 200/153 K

[58] Field of Search ..... 200/4, 6 A, 7, 11 R, 200/11 G, 11 K, 17 R, 18, 153 K, 303

[56] References Cited

U.S. PATENT DOCUMENTS

| | | | |
|---|---|---|---|
| 2,921,147 | 1/1960 | Hutt | 200/303 |
| 3,493,697 | 2/1970 | Sedory | 200/153 K X |
| 4,016,387 | 4/1977 | Aberer | 200/303 |
| 4,085,301 | 4/1978 | Smith | 200/4 |
| 4,225,758 | 9/1980 | Kondo et al. | 200/153 K X |

*Primary Examiner*—James R. Scott

*Attorney, Agent, or Firm*—Larry J. Palguta; John A. Young

[57] ABSTRACT

A multiple-function electrical switch has an automatic return to an initial position upon release of the shaft (60). An annular drive (70) mounted upon the shaft (60) has a rotary contactor (100) and momentary switch contacts (90,92) secured thereto, and a torsional spring (110) is mounted in a cover (36) enclosing one end of the housing (11). As the shaft is rotated, a tongue (78) on the driver (70) engages the torsional spring (110) which will effect return of the driver and shaft to its initial position upon release of the shaft. The tongue (78) is received in a pocket (56) located in the cover (36) such that the shaft (60) may be moved axially at only one rotational position, such movement effecting engagement between the momentary switch contacts (90,92) and terminals (44,46) disposed in the cover. The housing is insert molded about a collector (12) and terminals (14, 16, 18, 20, 22), the collector having a stepped portion (28) engaged by the rotary contactor (100) to provide a detent as the user rotates the contactor from a first selected terminal to a second selected terminal.

13 Claims, 6 Drawing Figures

MULTIPLE-FUNCTION SWITCH WITH AUTOMATIC RETURN

DESCRIPTION

1. Technical Field

The invention relates to multiple-function electrical switches actuated by rotational or axial displacement of the control shaft. The switch is connected to external circuits for selective operation of the circuits corresponding to the rotation or axial displacement of the shaft.

For use as a tuning switch with a digital radio, it is essential that the switch be small in size and have an automatic return to the inactive position upon the user's release of the control knob.

2. Background Art

Radio tuning switches are numerous within the art. Digital radios have more recently become popular in the automotive market. A digital radio typically has a face which displays a digital readout of the radio frequency to which the radio is tuned, plus other displays or indicators which may indicate that the radio is operating in a stereo mode or that a tape player is operating. Thus, it is desirable to produce a small, inexpensive switch control that can selectively actuate a stepping circuit which tunes the digital radio i.e., tuning up the frequency scale or down the frequency scale in either slow or rapid traverse modes. Such a control switch should not only actuate the various modes of selecting a new frequency for the digital radio, but have an automatic return to an inactive or initial position upon release of the switch control knob. Additionally, the switch should be capable of effecting a switching function upon axial movement of the knob so that an automatic seeking feature may be actuated to change the radio frequency to a preset frequency, or a track change in a tape player may be effected. The switch must be small in size, simply constructed, and easily assembled in a minimum number of steps and utilizing a minimum number of components.

DISCLOSURE OF THE INVENTION

The present invention comprises a multiple-function electrical switch having an automatic return to its initial null position upon release of the shaft. A torsional spring is mounted in a cover enclosing one end of a switch housing. As the shaft is rotated, a tongue on the driver engages the torsional spring which will effect return of the driver and shaft upon release of the shaft. The shaft and driver may be displaced axially to effect actuation of a momentary switching function by a set of contacts on the driver shunting a set of terminals disposed in the cover, the axial displacement being opposed by a helical spring. The tongue is received in a pocket situated in the cover, thereby limiting axial displacement to a predetermined rotational position. The collector has a stepped portion which provides a detent when the contactor is rotated between first terminals and second terminals.

BEST MODE FOR CARRYING OUT THE INVENTION

Figure 1:
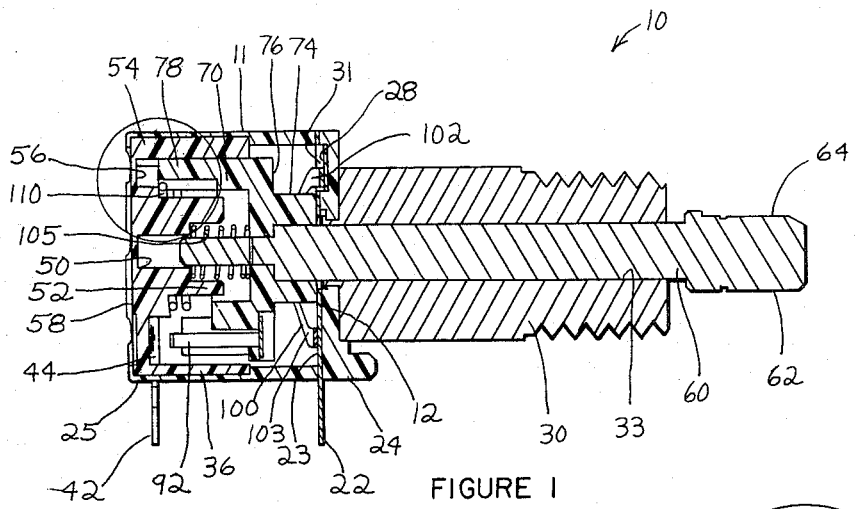
FIG. 1 is a section view of the multiple-function switch of the present invention.
Figures 4, 5:
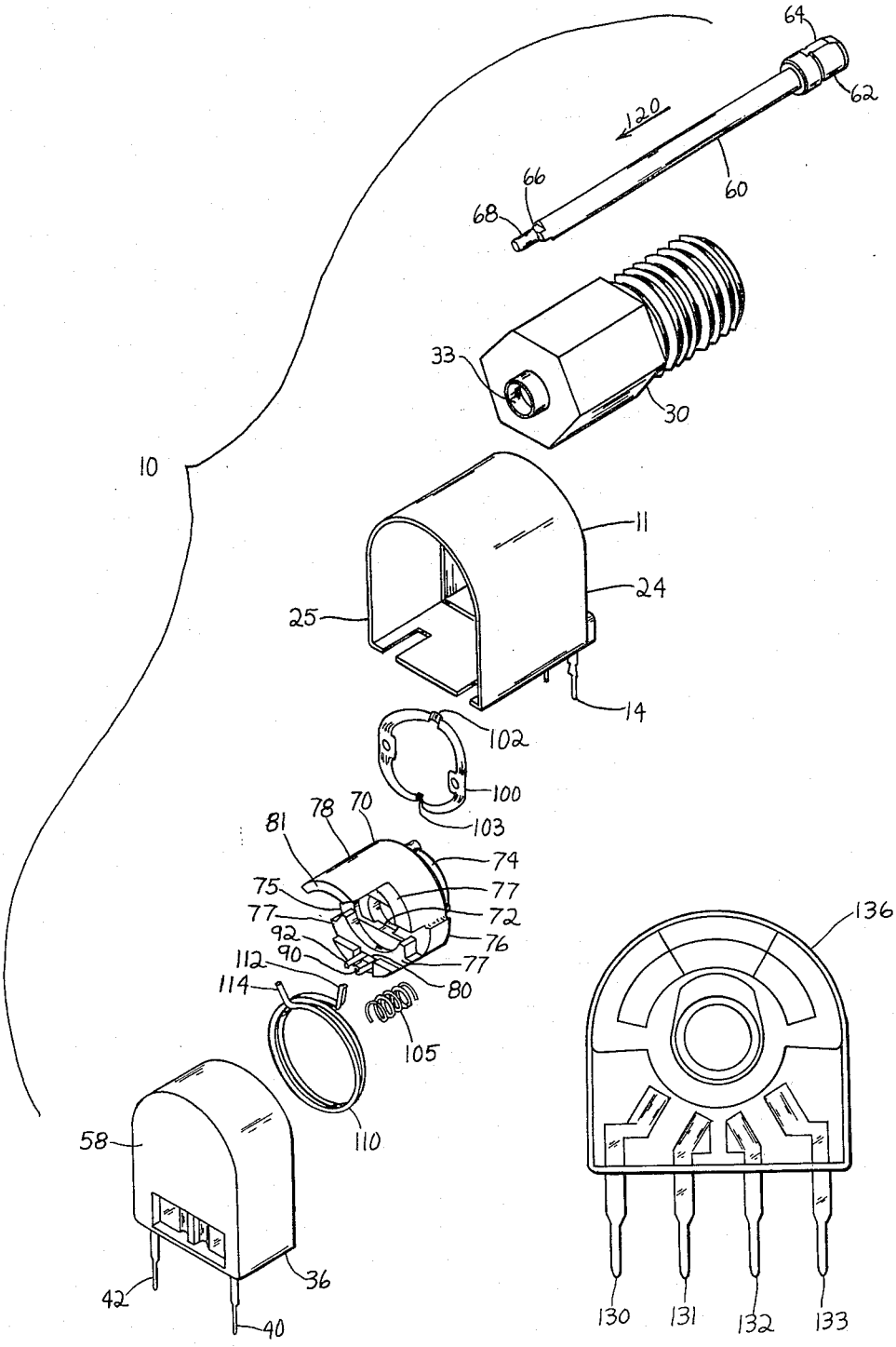
FIG. 4 is an exploded isometric view of the multiple-function switch.
FIG. 5 is an end view of a further embodiment of the cover.

Referring now to the drawings, FIGS. 1 and 4 show the multiple-function switch designated generally by reference numeral 10, and the insert molded housing 11 formed in the shape of a "dog house" and which contains a plurality of terminals therein. The housing is hollow and molded about a collector 12 and terminals 14, 16, 18, 20, and 22, terminal 22 being integral with the collector 12. The collector and terminals are disposed in end 24 of the housing which has an aperture or opening 26 circumposed by the collector. The collector has a stepped portion 28 adjacent the top portion of the housing. A threaded bushing 30 is mounted upon end 24, and is coaxial with the aperture 26.

Figure 3:
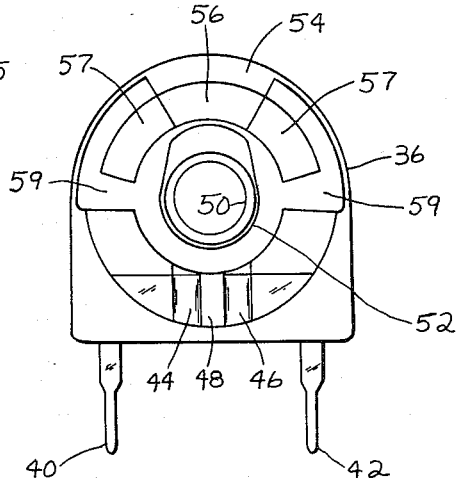
FIG. 3 shows the switch cover.

When the switch is assembled, a cover 36 will enclose the open end 25 of the housing 11, the cover being secured by heat staking the outer edges of the housing against the outer surface of the cover. FIG. 3 illustrates the cover 36 being insert molded about terminals 40 and 42, the terminals extending beyond the housing for connection to an external circuit. Terminal ends 44 and 46 are formed over and terminate in interior cover groove 48. The cover 36 has an aperture 50 with an axial sleeve 52 circumposed thereabout. Positioned within the top of the cover is the axial abutment 54 extending the length of the interior of the cover and directly below and radially inward of the abutment 54 is a pocket 56.

A shaft 60 is journaled in the threaded bushing 30 and extends axially throughout the housing. Shaft 60 has an enlarged end 62 having a key fitting 64 for mounting of a knob (not shown) thereon. The other end of the shaft 60 has reduced diameter 66 and annular end 68 which is received in the aperture 50 when the switch is assembled. A drive arm 70 is mounted upon the shaft 60. The drive arm 70 is generally annular in shape and has a key aperture 72 for fitting and mounting the drive arm upon the shaft, the key aperture 72 receiving the reduced diameter portion 66.

Referring now to FIGS. 1 and 4, drive arm 70 has on face 76 an axial extension 74 providing a bearing surface between the axial extension 74 and the end 24. A tongue 78 extends longitudinally or axially from the outermost radial portion of the drive arm 70, and slot opening 80 in the drive arm 70 receives a set of switch contacts 90, 92 secured by heat staking therein. Face 75 of the drive arm 70 has levels 77 thereon.

A resilient contactor 100 is mounted by heat staking upon the face 76. The resilient contactor is comprised of two resiliently formed contact arms 102, 103 extending axially from the face 76 of the drive arm 70. When the switch is assembled, contactor arm 102 is biased into engagement with the collector 12 and contactor arm 103 is biased into engagement with the upper terminal portion 23 of terminal 22. As the drive arm is rotated by the shaft 60, contactor arm 102 wipably engages the collector and contactor arm 103 sequentially engages the terminals 18 and 20 or terminals 16 and 14 depending upon the direction of rotation.

A torsional spring 110 is mounted in the cover 36. The spring arms 112 and 114 are spread circumferentially until each arm engages a respective side of abutment 54 (FIG. 1A), with the circular portion of the torsional spring 110 circumposing the axial sleeve 52. A helical spring 105 is mounted within the sleeve 52; one end of the helical spring 105 circumposes end 68 of the shaft 60. The spring 105 biases drive arm 70 and shaft 60 to a retracted position, i.e., toward the right in FIG. 1.

OPERATION

Figure 1A:
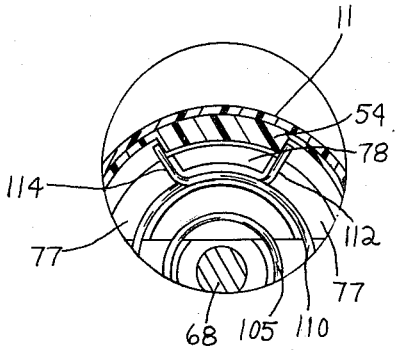
FIG. 1A is a detailed section end view of a portion of FIG. 1.

The multiple-function switch is assembled by mounting the bushing 30 upon the outer face of end 24 of the housing 11, and then journaling the shaft 60 in the longitudinal passage 33 of bushing 30. The drive arm 70 is then mounted upon the shaft, the key aperture 72 receiving the reduced diameter portion 66 of the shaft for rotation of the driver arm therewith. The drive arm 70 is positioned within the housing 11 so that the contactor arms 102 and 103 are biased into engagement with the collector 12 and upper terminal portion 23, respectively. Next, the torsional spring 110 is mounted in the cover 36 by positioning the annular portion of the spring about the sleeve 52 and spreading the spring arms 112 and 114 circumferentially away from each other so that each spring arm when released engages a respective side of the abutment 54 (FIG. 1A). The helical spring 105 is then mounted upon the annular portion 68 of the shaft 60 and the cover is placed within the open end 25 of the housing 11, the annular end 68 being received in the aperture 50 of the cover 36. The outer edges of the open end 25 of the housing are next heat staked over the side 58 of the cover 36 (See FIG. 1).

The multiple-function switch is then connected to external circuits, through the terminals 14, 16, 18, 20, 22, 40, and 42, and in particular to a stepping circuit for tuning the digital radio.

Figure 2:
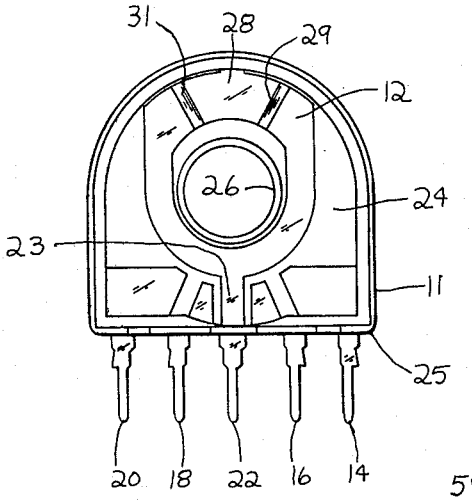
FIG. 2 is an end view from the open end of the switch housing.

Referring now to FIG. 2, if the shaft is rotated in a clockwise direction, the contactor arm 102 mounted upon the driver 70 is rotated clockwise and wipably contacts the stepped portion 28 of collector 12. The contactor arm 103 correspondingly moves in a clockwise direction from initial engagement with the upper terminal portion 23 to then wipably engages first the terminal 18, thereby completing a circuit across terminals 22 and 18. The stepping circuit will then tune the digital radio in a slow traverse mode, to seek a new radio frequency by moving up the frequency scale. At the same time, the tongue 78 engages torsional spring arm 114 which biases the tongue circumferentially back towards its initial inactive or null position. Further clockwise rotation of the shaft 60, results in further rotation of the drive arm and its attached contactor. Contactor arm 102 would first wipe over step edge 29 to provide the user with a positive detent feel indicating a change to a different traverse mode. Clockwise rotation of the contactor arm 102 beyond step edge 29 results in wipable engagement of the contactor arm 103 with the terminal 20 thereby completing a circuit across terminals 20 and 22. This circuit will tune the digital radio in a rapid traverse mode up the frequency scale of the radio. Release of the control knob (not shown) mounted upon the shaft 60 will result in an immediate automatic return of the shaft 60 to its initial inactive position by the action of the spring 110, as previously described. This automatic return occurs if the user releases the control knob in either the slow or rapid traverse mode, and repositions the shaft 60 and the attached structures to the initial null position.

Rotation of the control knob in a counterclockwise direction effects switch functions in the same manner as previously described but will tune the digital radio down the frequency scale. The contactor arm 102 will maintain wipable engagement with the collector 12 as the contactor arm 103 correspondingly moves from upper terminal portion 23 to terminal 16 to complete a circuit across terminals 22 and 16. This circuit will tune the digital radio in a slow traverse mode down the frequency scale, and subsequent counterclockwise rotation of the knob will move the contactor arm 102 over the detent step 31 to indicate to the user a change of tuning modes. The contactor arm 102 moves over step 31, while maintaining wipable contact with the collector 12, and the contactor arm 103 wipably engages terminal 14, completing a circuit across terminals 22 and 14. This circuit then tunes the digital radio in a rapid traverse mode down the frequency scale.

Thus, the digital radio may be tuned either up or down the frequency scale, in either slow or rapid traverse modes, as the user so desires.

An additional feature of the multiple-function switch is a switching function for various additional functions such as actuating an automatic seeking feature whereby the digital radio automatically tunes to a preselected frequency, or serving to actuate a track change in a tape cassette player. This is accomplished by the user displacing axially the knob (not shown) and shaft 60 which correspondingly displaces the drive arm 70 in the direction of arrow 120 (FIG. 4), the tongue 78 being received in the pocket 56. Simultaneously, the contacts 90, 92 (FIGS. 1, 4) engage the terminal ends 44, 46, respectively, to complete a circuit across the terminals 40, 42. Axial movement of the shaft 60 is opposed by the helical spring 105 mounted about the annular end 68 of driver 60, and release of the control knob results in the shaft and drive arm returning to their initial axial positions, and effecting the opening of the circuit across terminals 40, 42, as the contacts 90, 92 disengage the terminal ends 44, 46, respectively. The tongue and pocket construction is designed so that the drive arm may be displaced axially at only one rotational position, thereby protecting the contacts 90, 92 from damage by axial displacement of the drive arm 70 at other angular positions. If the drive arm 70 experiences an attempted axial displacement at a angular position wherein the tongue 78 is not aligned to be received by the pocket 56, the tongue end 81 would contact the interior walls 57 of the cover 36 to prevent such displacement. Additionally, flanges 59 disposed in the cover 36 will, upon rotation of the drive arm in either a clockwise or counterclockwise direction, engage the sides of the tongue to prevent further rotation of the drive arm.

Thus, the multiple-function switch may effect switching functions by either rotational or axial displacement of the shaft and its associated drive arm. Whether the shaft is displaced axially or rotationally, there is an automatic and immediate return of the shaft to its initial inactive position and a termination of the associated switching function as soon as the displacing force is removed from the shaft. The design features of the multiple-function switch limit axial displacement to only a predetermined rotary position and also prevent rotation beyond set limits. Another feature of the drive arm 70 is that the levels 77 serve to capture the torsional spring 110 and maintain it in axial alignment. As the drive arm is rotated, the torsional spring is compressed and tightened to reduce the inner diameter of the spring 110 such that the annular portion of the spring 110 tends to displace itself axially.

The multiple-function switch may be modified so that additional switching functions may be performed. Referring to FIG. 5, an additional set of terminals 132, 133 may be disposed within the cover 136, so that axial displacement of the shaft and drive arm will simultaneously effect circuits across the terminals 130, 131, and 132, 133. The drive arm 70 would, of course, have an additional set of contacts 90, 92 secured thereto for actuation of the circuit across the additional set of terminals added to the cover 136. Also, further modifications in the position of the terminals disposed in the molded housing will alter the number of degrees the drive arm and contactor must be rotated in order to complete a circuit across the collector terminal 22 and the next circumferentially aligned terminal.

INDUSTRIAL APPLICABILITY

The present invention may be used to selectively actuate distinct electrical circuits.

CONCLUSION

Although the present invention has been illustrated and described in connection with the example embodiments, it will be understood that this is illustrative of the invention, and it is by no means restrictive thereof. It is reasonably to be expected that those skilled in the art can make numerous revisions and additions of the invention and it is intended that such revisions and additions will be included within the scope of the following claims as equivalents of the invention.

We claim:

1. A multiple-function switch with positive rotational locking to effectively prevent rotational displacement upon axial displacement, comprising a housing having a plurality of housing terminals and a collector therein, said housing terminals extending from said housing, a driver having a resilient contactor, contacts secured to said driver, and a projection means, a shaft having said driver mounted thereon for rotation therewith, a cover having cover terminals disposed within an opening in said cover and extending from the cover and said cover have a receiving means, axially disposed resilient means for axially biasing said driver, and resilient means disposed about said axial resilient means and contained entirely within said housing whereby rotation of said shaft effects wiping engagement between said contactor, collector, and selected housing terminals and biases said projection means against said resilient means disposed about said axial resilient means whereby upon release of external rotation forces upon said shaft there is effected a return of said shaft and driver to an initial position, axial movement of said shaft displacing axially said projection means into said receiving means to effect a positive rotational locking of said driver and moving said contacts into engagement with said cover terminals whereby said cover terminals are electrically interconnected to complete a circuit thereacross.

2. The switch in accordance with claim 1, wherein said collector consists of an annular collector having a stepped portion therein, whereby as the shaft rotates said resilient contactor engages said stepped portion to effect a detent as said contactor moves over said stepped portion.

3. The switch in accordance with claim 1, wherein said receiving means comprises a pocket disposed in said cover and said projection means comprises a tongue, said tongue received in said pocket upon axial displacement of said driver.

4. The switch in accordance with claim 1, wherein said resilient means disposed about said axial resilient means comprises a torsional spring having radially extending ends and said projection means comprises a tongue, said radially extending ends disposed about respective sides of said tongue such that rotation of said shaft in a first direction biases said tongue against one of said ends and rotation of said shaft in a second direction biases said tongue against the other of said ends.

5. The switch in accordance with claim 1, wherein said driver includes an interior level for capturing said resilient means and preventing axial displacement upon compression of said resilient means.

6. The switch in accordance with claim 1, further comprising a threaded bushing mounted upon said housing, said shaft journaled within said threaded bushing.

7. The switch in accordance with claim 1, further comprising second contacts secured to said driver and associated terminals disposed in said cover, said second contacts engaging said associated contacts when said shaft is displaced axially.

8. The switch in accordance with claim 1, further comprising a sleeve means integral with said cover, said shaft being journaled by said sleeve means.

9. A process for effecting multiple-function electrical switching functions including a positive rotational locking to prevent rotational displacement upon axial displacement, comprising the steps of rotationally displacing a shaft having a driver including a projection means to effect wipable engagement between a resilient contactor, a collector, and selected terminals disposed within a housing of a switch, opposing said rotational movement with a resilient means contained completely within said housing and which engages said projection means upon said rotational movement whereby release of said shaft allows return of said shaft, driver, and resilient contactor to an initial position, axially displacing said shaft, driver, and projection means so that said projection means enters a receiving means and effecting actuation of a switch means, and opposing said axial displacement of said shaft through a resilient means acting upon the driver which is mounted on said shaft, said driver being axially displaceable in a preselected rotational position of said driver and a positive rotational locking effected upon said axial displacement.

10. The process in accordance with claim 9, including the step of providing a stepped portion in said collector whereby upon rotation of the shaft said resilient contactor engages said stepped portion to effect a detent as said resilient contactor moves over the stepped portion.

11. The process in accordance with claim 9, including the steps of mounting said resilient means for opposing said rotational movement about a sleeve means disposed in a cover of said housing and said driver maintaining axial alignment of said resilient means.

12. The process in accordance with claim 9, further comprising the step of journalling said shaft in an axial sleeve means disposed in a cover of said housing.

13. The process in accordance with claim 9, further comprising the step of disposing a second switch means in said switch for effecting a second switching function upon axial displacement of said shaft and driver.

* * * * *